US005672021A

United States Patent [19]

Abber et al.

[11] Patent Number: 5,672,021

[45] Date of Patent: Sep. 30, 1997

[54] FIBROUS NIB FOR USE IN A CAPILLARY FEED MARKER

[75] Inventors: Herman Abber, Brockton; Lee A. Carlson, Southboro; Lewis H. Johnson, Mansfield, all of Mass.; Craig L. Donaldson, Yorba Linda, Calif.

[73] Assignee: Avery Dennison Corporation, Pasadena, Calif.

[21] Appl. No.: 386,482

[22] Filed: Feb. 10, 1995

[51] Int. Cl.[6] ..... B43K 8/04

[52] U.S. Cl. ..... 401/199; 401/265; 401/292

[58] Field of Search ..... 401/199, 265, 401/292

[56] References Cited

U.S. PATENT DOCUMENTS

| | | | |
|---|---|---|---|
| 3,141,187 | 7/1964 | Simon, Jr. et al. . | |
| 3,442,739 | 5/1969 | Johnson | 401/198 X |
| 3,480,372 | 11/1969 | Kenny et al. | 401/198 |
| 3,558,392 | 1/1971 | Goodenow et al. . | |
| 3,623,941 | 11/1971 | Goodenow et al. . | |
| 3,718,401 | 2/1973 | Kiriu | 401/199 |
| 4,378,622 | 4/1983 | Pinkston et al. . | |
| 4,970,854 | 11/1990 | Komiya et al. | 401/199 X |
| 5,362,167 | 11/1994 | Loftin . | |

FOREIGN PATENT DOCUMENTS

| | | | |
|---|---|---|---|
| 251280 | 11/1987 | German Dem. Rep. | 401/199 |
| 50-37571 | 12/1975 | Japan | 401/198 |
| 51-46226 | 4/1976 | Japan | 401/198 |
| 154627 | 12/1979 | Japan | 401/199 |
| 199698 | 12/1982 | Japan | 401/198 |
| 609617 | 3/1979 | Switzerland | 401/199 |
| 1341571 | 12/1973 | United Kingdom . | |

*Primary Examiner*—Steven A. Bratlie
*Attorney, Agent, or Firm*—Kriegsman & Kriegsman

[57] ABSTRACT

A nib for use in a capillary feed marker. According to a preferred embodiment of the invention, the nib comprises a bundle of substantially parallel, absorbent fibers fashioned into a porous structure, some of the fibers being made of a water-soluble (or solvent-soluble) material, other of the fibers being made of a water-insoluble (or solvent-insoluble) material. By dissolving the soluble fibers of the nib while keeping the insoluble fibers of the nib intact, capillaries of an enlarged size may be formed in the nib.

16 Claims, 1 Drawing Sheet

FIBROUS NIB FOR USE IN A CAPILLARY FEED MARKER

BACKGROUND OF THE INVENTION

The present invention relates generally to capillary feed markers and more particularly to fibrous nibs of the type typically used in capillary feed markers.

Capillary feed markers are a well-known type of writing instrument. Typically, a capillary feed marker comprises an elongated, hollow, cylindrical body. The cylindrical body is typically open at its top end and is shaped to define an axially-extending ink reservoir also open at its top end. A first absorbent porous material, commonly referred to as a filler, typically has a size and shape approximating that of the ink reservoir and is positioned within the ink reservoir. A second absorbent porous material, commonly referred to as a nib, typically has an elongated shape and is positioned so that one end thereof is placed in contact with the filler so as to draw ink therefrom by capillary action and so that the other end of the nib extends out through the open top end of the cylindrical body for use in applying ink to a desired substrate. An example of a typical capillary feed marker is disclosed in U.S. Pat. No. 3,141,187, inventors Simon, Jr. et al., which issued Jul. 21, 1964, and which is incorporated herein by reference.

The filler and the nib may be made of the same or different types of materials, although the filler typically has a larger pore or capillary size than the nib to ensure that ink flows from the filler to the nib. One common class of nib materials are felts, i.e., structures comprising random arrangements of natural or synthetic fibers typically fashioned by matting. Another common class of nib materials comprise bundles of substantially parallel natural or synthetic fibers. One common way in which the latter class of nibs is made is disclosed in U.S. Pat. No. 3,558,392, inventors Goodenow et al., which issued Jan. 26, 1971, or in U.S. Pat. No. 3,623,941, inventors Goodenow et al., which issued Nov. 30, 1971, both of which are incorporated herein by reference.

The nib fabrication process described in the aforementioned patents is essentially as follows: First, a plurality of spools of wound fibers are provided, the number of spools corresponding to the number of fibers that are to be present in the finished nib. The fibers are then pulled from their respective spools through corresponding perforations in a gathering or arranging plate so that the fibers are oriented parallel to one another. The gathered fibers are then pulled through a drying zone to dry the fibers. Next, the gathered fibers are pulled through a heated tunnel which causes the gathered fibers to adhere to one another and which causes the cross-sectional diameter of the bundle of fibers to be compressed to the desired diameter of the finished nib. The heat-set bundle is then drawn through a cooling area.

Next, the cooled bundle is drawn through a bath containing a dilute solution of a curable resin in a volatile solvent maintained at a temperature below the curing temperature of the resin and below the boiling temperature of the solvent. Next, the resin-impregnated bundle is drawn first through a drying or solvent removal zone and then through a heat curing zone, although the drying and curing zones may be combined into a single zone. The cured bundle is then drawn through a cooling zone and passed through a set of rollers, the rollers constituting the tensioning and advancing means for the production line. The cooled bundle is then cut and, if necessary, shaped into finished nibs. The finished nibs may then be treated with a wetting agent to facilitate the wetting of the nib and to faciliate the movement of ink through the capillaries (i.e., the channels formed between adjacent fibers) of the nib.

Although nibs of the type described above have become widely used in capillary feed markers, one problem that frequently arises when such nibs are used to dispense pigmented inks or other inks having large particulate matter is that the capillaries of the nib tend to become clogged by the particulate matter, thereby impeding the flow of ink through the nib. This problem is particularly common when the above-described nibs are used in capillary feed markers to dispense erasable inks, many of which include resinous matter. See e.g., U.S. Pat. No. 5,362,167, inventor Loftin, which issued Nov. 8, 1994; U.S. Ser. No. 08/139,560, filed Oct. 20, 1993; U.S. Ser. No. 08/097,461, filed Jul. 27, 1993; and U.S. Ser. No. 08/194,466, filed Feb. 10, 1994, all of which are herein incorporated by reference.

Accordingly, there clearly exists a need for a nib suitable for use in a capillary feed marker which does not become as easily clogged as do existing nibs, particularly when used with inks containing large particulate matter.

Other patents and publications of interest include U.S. Pat. No. 4,378,622, inventors Pinkston et al., which issued Apr. 5, 1983, and UK Patent Specification No. 1,341,571, published Dec. 28, 1973, both of which are herein incorporated by reference.

SUMMARY OF THE INVENTION

It is an object of the present invention to provide a novel nib for use in a capillary feed marker.

It is another object of the present invention to provide a nib as described above which overcomes at least some of the problems discussed above in connection with conventional nibs.

It is still another object of the present invention to provide a nib as described above which is suitable for use with pigmented inks, erasable inks and other inks containing large particulate matter.

Additional objects, as well as features and advantages, of the present invention will be set forth in part in the detailed description which follows, and in part will be obvious from the detailed description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

In furtherance of the above and other objects to be described or to become apparent below, there is hereinafter provided a nib for use in a capillary feed marker, said nib comprising a plurality of fibers fashioned into a porous structure, some of said fibers being made of a first material, other of said fibers being made of a second material not identical to said first material, said fibers of said first material being eliminatable from said porous structure, said fibers of said second material not being eliminatable from said porous structure. As can be appreciated, by eliminating said fibers of said first material while keeping said fibers of said second material intact, capillaries (i.e., pores) of an enlarged size may be formed in the nib.

The fibers of the nib may be oriented generally parallel to one another in the form of a bundle or may be oriented randomly in the form of a felt. In accordance with one embodiment of the invention, to permit the selective elimination of the fibers of the first material from the porous structure, the fibers of the first material are made of a water-soluble material and the fibers of the second material are made of a water-insoluble material. In this manner, the water-soluble fibers may be eliminated by treating the nib with water or an aqueous solution. According to another embodiment of the invention, the fibers of the first material are made of a nonpolar solvent-soluble material and the fibers of the second material are made of a nonpolar solvent-insoluble material. In this manner, the solvent-soluble fibers may be eliminated by treating the nib with a nonpolar solvent. According to still another embodiment of the invention, the fibers of the first material are made of a meltable or sublimable material and the fibers of the second material are made of a heat-stable material. In this manner, the meltable or sublimable fibers may be eliminated by heating the nib (if necessary, in the presence of moisture).

The present invention is also directed to a method of making a nib for a capillary feed marker, said method comprising the steps of (a) providing a plurality of fibers, some of said fibers being made of a first material, other of said fibers being made of a second material not identical to said first material, said fibers of said first material being eliminatable (e.g., soluble, meltable or sublimable) from said porous structure, said fibers of said second material not being eliminatable from said porous structure; and (b) fashioning said plurality of fibers into a porous structure. The porous structure may be in the form of a felt or may be in the form of a bundle of parallel fibers. Preferably, said method further comprises the step of eliminating said fibers of said first material to create capillaries (i.e., pores) of enlarged diameter. The eliminating step may be performed after the fashioning step (either as a post-processing step or in situ in a capillary feed marker upon contact with the ink contained therein) or may be performed during the fashioning step.

The present invention is also directed to a nib having enlarged capillaries made by the above-described method.

The present invention is further directed to a capillary feed marker comprising a nib of the present invention.

The present invention is still further directed to a nib for use in a capillary feed marker, said nib comprising a plurality of fibers fashioned into a porous structure, at least some of said fibers being hollow.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

As indicated above, when capillary feed markers having fibrous nibs are used to apply ink, particularly pigmented inks or other inks having large particulate matter, to a writing surface, it is not uncommon for the particulate matter to clog the capillaries of the nibs. This is because the capillaries of most nibs are rather small in diameter, due mainly to the fact that the fibers used to form such nibs are similarly small in diameter (thereby permitting the constituent fibers to be packed with little space therebetween). One solution to this problem which has been explored has been to use larger diameter fibers for a nib of the same external dimensions so that larger diameter capillaries will be formed. This solution, however, has been largely unsatisfactory since it has resulted in nibs of significantly reduced strength (due to the reduction in the number of constituent fibers). As will be described below in greater detail, the present invention solves the above-described problem by providing an alternative way in which enlarged capillaries can be formed in a nib.

Figure 1:
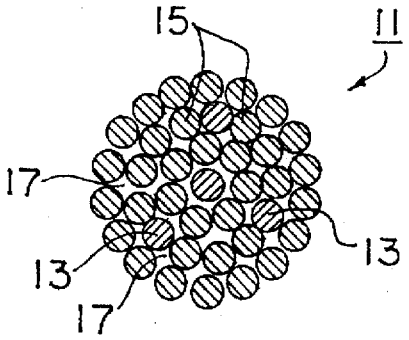
FIG. 1 is a simplified section view of a first embodiment of a nib constructed according to the teachings of the present invention.

Referring now to FIG. 1, there is shown a simplified section view of a first embodiment of a capillary feed marker nib constructed according to the teachings of the present invention, the nib being represented generally by reference numeral 11.

Nib 11, which may be made according to the method disclosed in U.S. Pat. Nos. 3,558,392 and 3,623,941, includes a plurality of fibers fashioned into a porous structure, some of the fibers 13 being made of a first material, the remainder of the fibers 15 being made of a second material. Capillaries 17 represent the voids between fibers 13 and 15. A sheath (not shown) may be used to surround and to hold together fibers 13 and 15 of nib 11. In accordance with the teachings of the present invention, fibers 13 are made of an eliminatable material whereas fibers 15 are not. For illustrative purposes only, according to one embodiment, fibers 13 may be made of a water-soluble material and fibers 15 may be made of a water-insoluble material. Alternatively, according to a second embodiment, fibers 13 may be made of a nonpolar solvent-soluble material and fibers 15 may be made of a nonpolar solvent-insoluble material. Or, according to a third embodiment, fibers 13 may be made of a meltable or sublimable material and fibers 15 may be made of a heat-stable material. Examples of water-soluble materials include polyvinyl alcohol, polyvinylpyrrolidone, polyacrylic acid, ethylcellulose and methoxymethylcellulose. Examples of nonpolar solvent-soluble materials include polyamides, uncrosslinked polyester, solvent soluble acrylics and polyvinyl acetate. Certain grades of polyvinyl alcohol in the presence of moisture may be suitable as a meltable or sublimable material.

Figure 2:
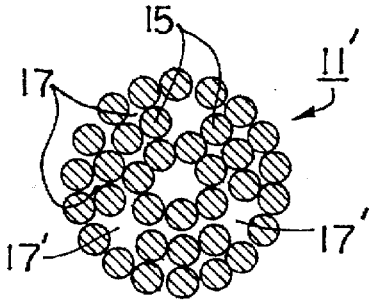
FIG. 2 is a simplified section view of the nib of FIG. 1 after some of its fibers have been eliminated in accordance with the teachings of the present invention.

Referring now to FIG. 2, there is shown a simplified section view of the nib of FIG. 1 after fibers 13 have been eliminated therefrom, either by solubilization with an appropriate liquid or by melting or sublimation, the modified nib being represented generally by reference numeral 11'. As can readily be observed, the cross-sectional diameter of certain capillaries 17' are enlarged following the elimination of fibers 13 from nib 11.

The elimination of fibers 13 in the manner described above can be accomplished at one or more of a variety of times during or after the manufacture of the nib. For example, in the context of the method described in U.S. Pat. No. 3,558,392, fibers 13 could be eliminated at one or more of the following stages: (1) while the bundle is being passed between heat-setting zone 9 and impregnation zone 14; (2) while the bundle is being passed between solvent removal zone 18 and heat curing zone 24; (3) after the bundle is cut and formed into a nib but prior to incorporating the nib into a capillary feed marker. Alternatively, nib 11 could be incorporated into a capillary feed marker containing a solubilizing ink (e.g., an aqueous ink for water-soluble fibers), in which case the ink would be used to eliminate fibers 13 from nib 11 in situ.

Figure 3:
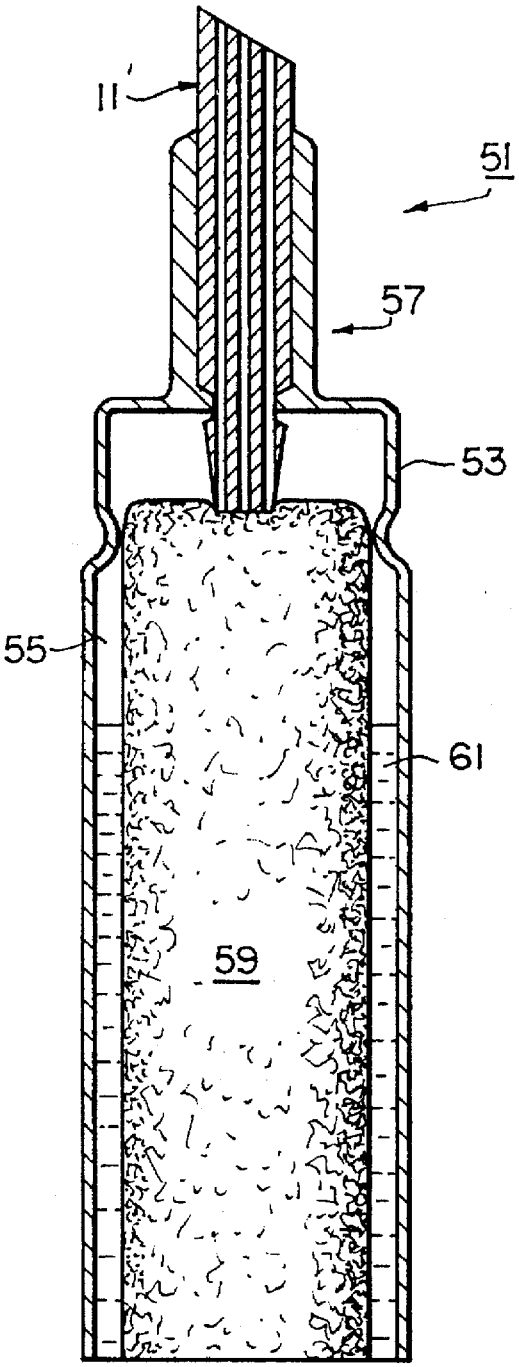
FIG. 3 is a simplified section view of a capillary feed marker which includes the nib of FIG. 2.

A simplified section view of an exemplary capillary feed marker which includes nib 11' is shown in FIG. 3, the marker being represented generally by reference numeral 51. As can be seen, marker 51 includes a hollow cylindrical body 53 shaped to define an ink reservoir 55, body 53 having an open end 57 for accessing reservoir 55. A filler 59 and ink 61 are disposed within reservoir 55. Nib 11' has a first end in contact with filler 59 and a second end which extends through open end 57.

Figure 4:
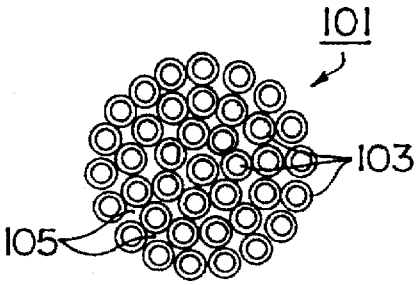
FIG. 4 is a simplied end view of a second embodiment of a nib constructed according to the teachings of the present invention.

Referring now to FIG. 4, there is shown a simplied end view of a second embodiment of a nib constructed according to the teachings of the present invention, the nib being represented generally by reference numeral 101.

Nib 101, which may also be made according to the method disclosed in U.S. Pat. Nos. 3,558,392 and 3,623,941, includes a plurality of fibers 103 fashioned into a porous structure, fibers 103 being hollow. Capillaries 105 represent the voids between fibers 103. As can readily be appreciated, because fibers 103 are hollow, ink can flow either through capillaries 105 or through fibers 103.

It is to be understood that, even though the nibs specifically shown and described herein are of the type having generally parallel fibers, the principles discussed above can also be applied to felt nibs.

It is also to be understood that the principles discussed above in connection with the fabrication of nibs having enlarged capillaries can similarly be used to make fillers having similarly enlarged capillaries.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A capillary feed marker comprising:

(a) an elongated hollow body, said elongated hollow body being shaped to include an ink reservoir and an opening at one end thereof;

(b) an elongated nib mounted in said elongated hollow body, said elongated nib having a first end thereof disposed within said ink reservoir to receive ink therefrom and having a second end thereof extending out through said opening in said elongated hollow body for use in applying ink to a substrate, said elongated nib being made by (i) providing a plurality of fibers, some of said fibers being made of a first material, other of said fibers being made of a second material not identical to said first material, said fibers of said first material being completely dissolvable, said fibers of said second material not being completely dissolvable, (ii) fashioning said plurality of fibers into a porous structure, said porous structure having a plurality of capillaries formed between said plurality of fibers, and (iii) completely dissolving said fibers of said first material so that capillaries defined, at least in part, by said fibers of said first material may be enlarged upon dissolution of said fibers of said first material from said porous structure.

2. The capillary feed marker of claim 1 further comprising a quantity of ink located within said ink reservoir.

3. The capillary feed marker of claim 2 further comprising a filler disposed within said ink reservoir.

4. A method of making a nib for a capillary feed marker, said method comprising the steps of:

(a) providing a plurality of fibers, some of said fibers being made of a first material, other of said fibers being made of a second material not identical to said first material, said fibers of said first material being completely dissolvable, said fibers of said second material not being completely dissolvable;

(b) fashioning said plurality of fibers into a porous structure, said porous structure having a plurality of capillaries formed between said plurality of fibers; and (c) completely dissolving said fibers of said first material so that capillaries defined, at least in part, by said fibers of said first material may be enlarged upon dissolution of said fibers of said first material from said porous structure.

5. The method as claimed in claim 4 wherein said fashioning step comprises randomly arranging said plurality of fibers relative to one another.

6. The method as claimed in claim 4 wherein said fashioning step comprises orienting said plurality of fibers generally parallel to one another.

7. The method as claimed in claim 4 wherein said dissolving step is performed after said fashioning step.

8. The method as claimed in claim 4 wherein said dissolving step is performed during said fashioning step.

9. The nib made by the method of claim 4.

10. A method of making a nib for a capillary feed marker, said method comprising the steps of:

(a) providing a plurality of fibers, some of said fibers being made of a first material, other of said fibers being made of a second material not identical to said first material, said fibers of said first material being completely meltable or sublimable, said fibers of said second material not being completely meltable or sublimable;

(b) fashioning said plurality of fibers into a porous structure, said porous structure having a plurality of capillaries formed between said plurality of fibers; and (c) heating said fibers of said first material until they completely melt or sublimate whereby capillaries defined, at least in part, by said fibers of said first material are enlarged.

11. The method as claimed in claim 10 wherein said heating step is performed after said fashioning step.

12. The method as claimed in claim 10 wherein said heating step is performed during said fashioning step.

13. The nib made by the method of claim 10:

14. The method as claimed in claim 10 wherein said fashioning step comprises randomly arranging said plurality of fibers relative to one another.

15. The method as claimed in claim 10 wherein said fashioning step comprises orienting said plurality of fibers generally parallel to one another.

16. A capillary feed marker comprising:

(a) an elongated hollow body, said elongated hollow body being shaped to include an ink reservoir and an opening at one end thereof;

(b) an elongated nib mounted in said elongated hollow body, said elongated nib having a first end thereof disposed within said ink reservoir to receive ink therefrom and having a second end thereof extending out through said opening in said elongated hollow body for use in applying ink to a substrate, said elongated nib being made by (i) providing a plurality of fibers, some of said fibers being made of a first material, other of said fibers being made of a second material not identical to said first material, said fibers of said first material being completely meltable or sublimable, said fibers of said second material not being completely meltable or sublimable, (ii) fashioning said plurality of fibers into a porous structure, said porous structure having a plurality of capillaries formed between said plurality of fibers, and (iii) heating said fibers of said first material until they completely melt or sublimate whereby capillaries defined at least in part, by said fibers of said first material are enlarged.

* * * * *